US007009621B1

(12) United States Patent
Tong

(10) Patent No.: US 7,009,621 B1
(45) Date of Patent: Mar. 7, 2006

(54) METHOD AND COMPUTER PROGRAM PRODUCT FOR REDUCING COLORMAP FLASHING

(75) Inventor: David Philip Tong, Santa Clara, CA (US)

(73) Assignee: Sun Microsystems, Inc., Palo Alto, CA (US)

( * ) Notice: Subject to any disclaimer, the term of this patent is extended or adjusted under 35 U.S.C. 154(b) by 480 days.

(21) Appl. No.: 09/546,993

(22) Filed: Apr. 11, 2000

(51) Int. Cl.
*G09G 5/02* (2006.01)

(52) U.S. Cl. ..... 345/589; 345/581; 345/601; 345/602

(58) Field of Classification Search ..... 345/589, 345/601, 602, 581, 592, 593, 597, 600
See application file for complete search history.

(56) References Cited

U.S. PATENT DOCUMENTS 5,406,310 A * 4/1995 Aschenbrenner et al. ... 345/602
5,703,627 A * 12/1997 Young ..... 345/600

* cited by examiner

*Primary Examiner*—Patrick N. Edouard
*Assistant Examiner*—Faranak Fouladi
(74) *Attorney, Agent, or Firm*—Kent A. Lembke; William J. Kubida; Hogan & Hartson LLP

(57) ABSTRACT

A method and computer program product for reducing colormap flashing on a display system where the display system has a single hardware colormap. The method includes the steps of intercepting a request from an application program for an allocation of a private colormap, and transparently simulating the allocation of the private colormap using the default colormap. In this manner, colormap flashing is reduced as the default colormap is used to satisfy private colormap requests.

7 Claims, 9 Drawing Sheets

METHOD AND COMPUTER PROGRAM PRODUCT FOR REDUCING COLORMAP FLASHING

FIELD OF THE INVENTION

This invention relates in general to management of computer displays, and more specifically to management of computer displays utilizing 8-bit frame buffer hardware managed by a server using the "X Windows" protocol.

BACKGROUND OF THE INVENTION

In conventional computing systems, a frame buffer is provided in the system's hardware which is used to store the contents of the display of the computing system at any given time. The term "frame buffer", as used herein, refers to the entire video display interface including acceleration hardware and other components as appropriate. The frame buffer is traditionally controlled and manipulated by a software program which regulates access to the display as requested by various application programs running on the computing system. For example, in a computing system utilizing the X Windows display protocol, an 8 bit frame buffer can be provided in the computer's hardware and controlled through the X Windows application program interface. The X Windows protocol permits a number of programs, known as X clients, to communicate with the interface, known as the X server, and thus modify the viewable display.

Conventionally, an 8 bit frame buffer can display up to 256 different colors typically from a palette of $2^{24}$ (or 16,777,216) colors. Each of the 256 colors can be designated and selected by a X client, through a color lookup table known as a "colormap." A conventional colormap for an 8 bit frame buffer has 256 ($2^8$) addressable entries or cells, each cell representing a "pixel" value defining a color displayable on the display. FIG. 1 shows an example of a colormap, having 256 cells. Each cell contains a multi-bit field which, among other things, dictates the color associated with the cell, and whether the cell is a read-only cell or a read/write cell. By default, the colormap cells are considered "empty" until allocated and initialized by the server at the request of an X client. The color of an empty cell is undefined. The operation of a colormap and the X Windows protocol is described in "The Xlib Programming Manual", by O'Reilly and Associates Inc. publishers, 1988 (ISBN 0-937175-13-7), which is hereby expressly incorporated by reference in its entirety.

The application programs (i.e., the X clients) running on the computing system manipulate the cells in a colormap through the X server interface, and the frame buffer hardware accesses the cells in the colormap to determine the color of any pixel displayed. The mechanism typically takes this form: the client may request that a specific color be made available to it by allocating an entry in the default colormap. The X server will attempt to satisfy the request but may refuse if there are no unallocated cells available. At this point, the client has several options: for example, it may try to allocate a different color, ignore the error and assume that the request succeeded, or exit with an error. Alternatively, it may create a "private colormap" which gives the client a full set of 256 cells that are not shared with any other client.

In conventional computing systems, a display or colormap "flashing" problem occurs if the display hardware of the computing system is equipped with a frame buffer capable of accessing only a single hardware colormap at any one time. For example, Sun Microsystems' CG6 frame buffer hardware, or the GX hardware, is an 8 bit frame buffer which supports only one colormap at any one time. As the user moves between a client that uses the default colormap and one that has defined a private colormap, the X server automatically updates the values in the frame buffer's hardware colormap.

For example, the default colormap may have used cells 0 and 1 to display black and white. But the private colormap may have entirely different R, G, B values, and thus colors, in these locations.

When the default colormap switches out, the private colormap values are applied to all of the displayed color images and windows, with the result that windows and images displayed in on the screen may appear to be abnormally or seemingly randomly colored since these images relied upon the values stored in the default colormap. The image associated with the X client which allocated the private colormap will, of course, appear as it should, since it is now using the colors from the private colormap. If the user then activates a window which relies on the default colormap, the default colormap is then applied to all images and the image associate with the private colormap will then appear to be abnormally or randomly colored. This problem is referred to herein variously as "display flashing", "colormap flashing", or simply "flashing".

What is needed is a method and computer program product for reducing display flashing in a computing system where the display hardware of the computing system is equipped with a frame buffer capable of accessing only a single hardware colormap at any one time. The system and method should operate transparently with respect to legacy software applications, and should not require any changes to the hardware of the computing system or display devices. It with this background in mind that the present invention was developed.

SUMMARY OF THE INVENTION

In light of the above, and according to a broad aspect of the invention, disclosed herein is a method and computer program product for reducing colormap flashing on a display system where the display system has a single hardware colormap. The method includes the steps of intercepting a request from an application program for an allocation of a private colormap, and transparently simulating the allocation of the private colormap using the default colormap. In this manner, colormap flashing is reduced as the default colormap is used to satisfy private colormap requests.

The above steps in another implementation of the invention are provided as an article of manufacture, i.e., a computer storage medium containing a computer program of instructions for performing the above-described steps.

The foregoing and other features, utilities and advantages of the invention will be apparent from the following more particular description of a preferred embodiment of the invention as illustrated in the accompanying drawings and claims.

DETAILED DESCRIPTION OF PREFERRED EMBODIMENTS

In accordance with the present invention, a masked software interface is provided which intercepts calls to the graphical X-routines and processes the calls so that the application program generating the requests believes that the calls are being satisfied without error. The inventive software interface transparently satisfies the color requests of the X-client applications without changing or switching out the default colormap, thereby reducing colormap flashing. As will be described, the tradeoff is that the colors, in some instances, are the closest available matched colors which may result in a reduction in the quality of display rendering together with a minor performance reduction.

Figure 1:
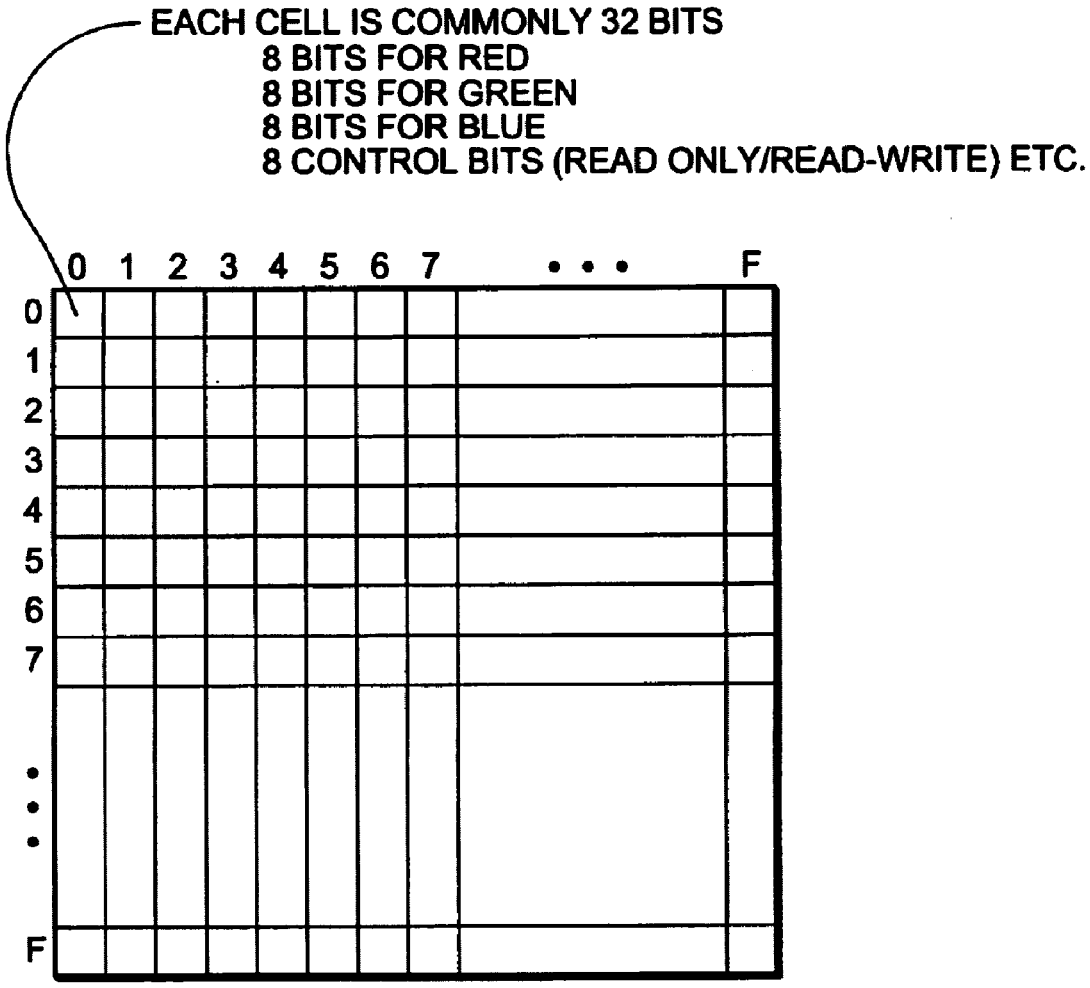
FIG. 1 illustrates an example of a colormap for a display system having an eight-bit frame buffer.
Figure 2:
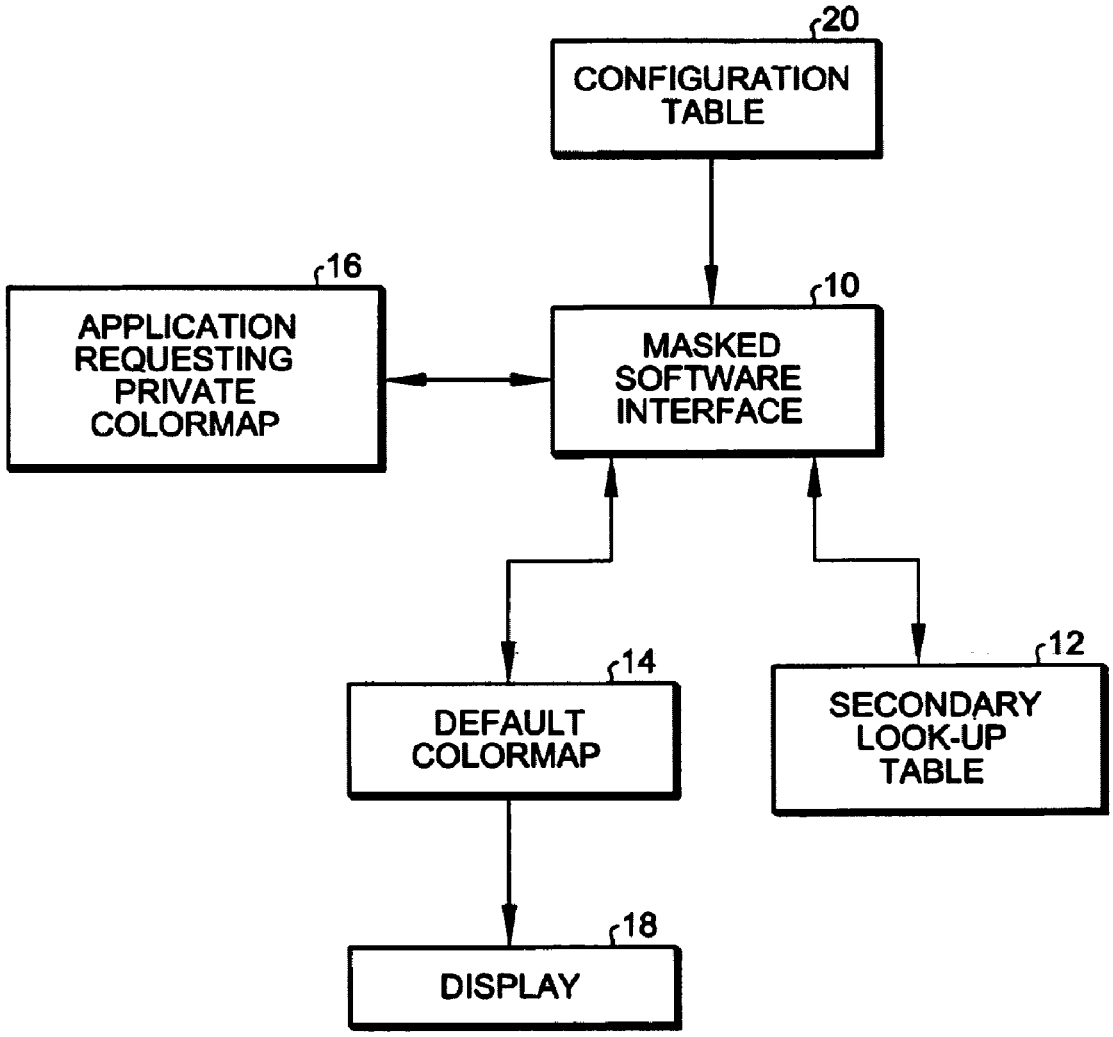
FIG. 2 illustrates a block diagram of the present invention for performing the operations of the present invention.
Figure 7:
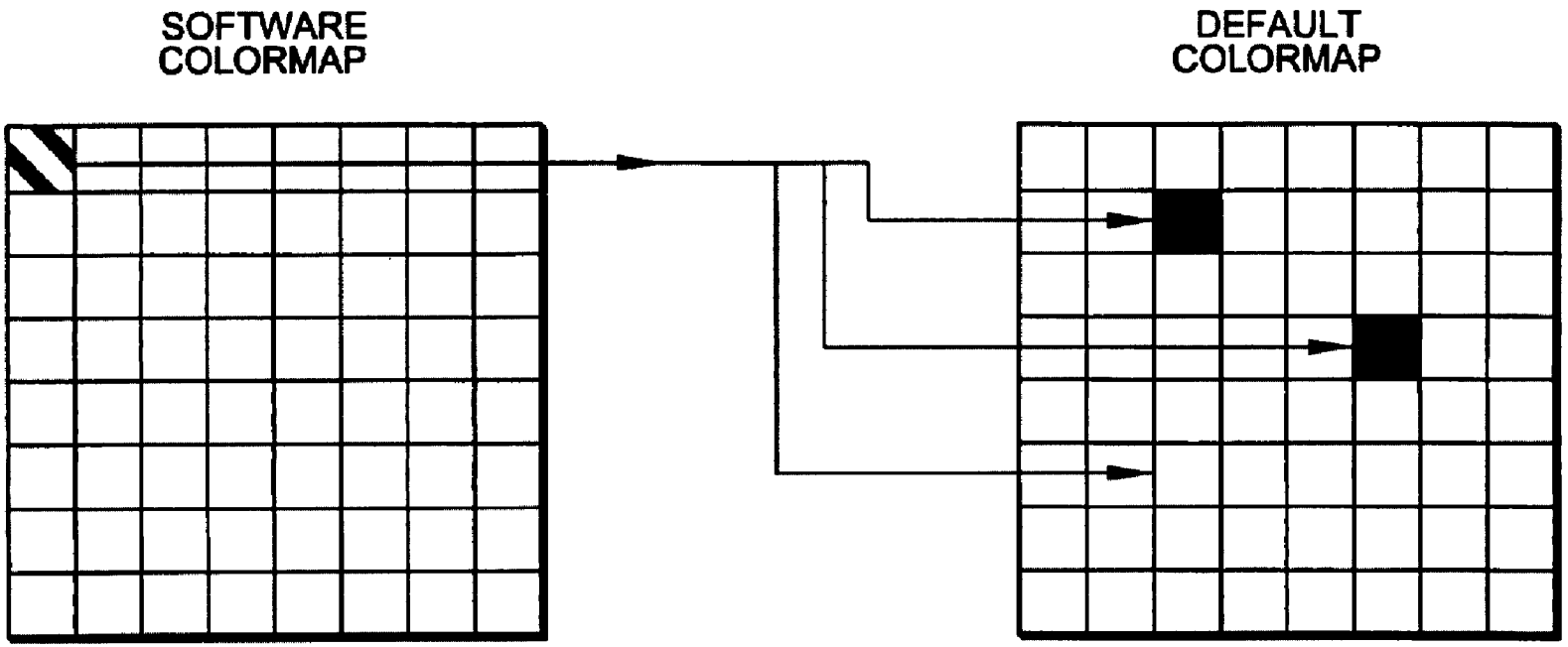
FIG. 7 shows an example of a mapping from the secondary lookup table to the default colormap in accordance with the present invention.

FIG. 2 shows a block diagram of a system incorporating one embodiment of the present invention. Masked software interface 10 creates and manages a secondary lookup-table 12, which maps to the default colormap 14 (FIG. 7) as will be described below. The software interface 10 intercepts and processes graphical requests or calls from an application program 16 (i.e., an X client application) which involve private colormap allocations. The interface 10 uses the default colormap 14 to satisfy the private colormap requests of application 16, without switching out the default colormap 14 from the display hardware 18 (i.e., frame buffer). In this manner, the display hardware 18 maintains the default colormap 14 without switching to a private colormap, and therefore colormap flashing is prevented.

A configuration table 20 can be provided with the interface 10 so that the user can preset certain operational variables to select or deselect certain functions performed by the software interface 10.

Figure 3:
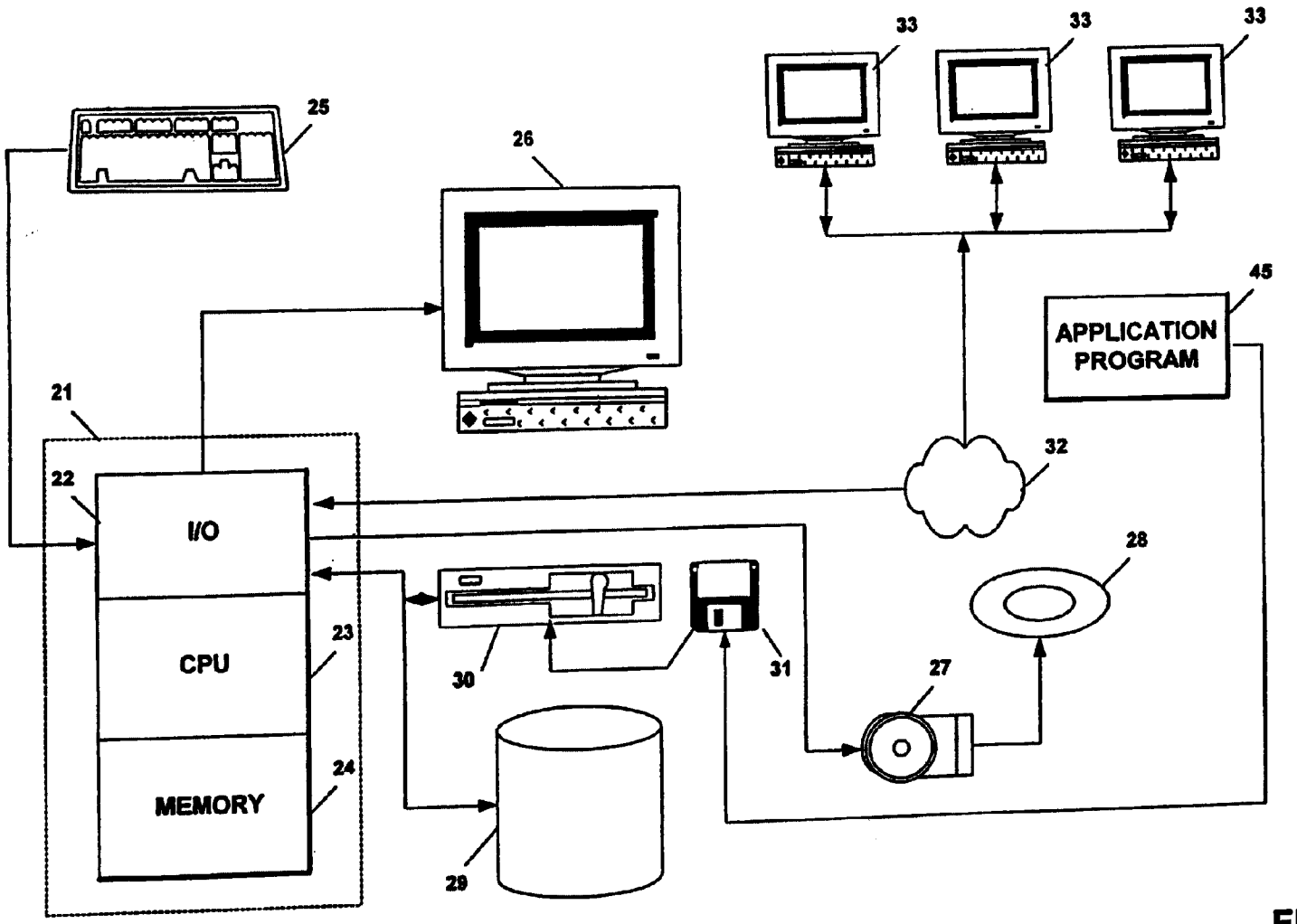
FIG. 3 illustrates a block diagram of a computer system, which may be part of a network computer system, showing one environment in which the present invention may be employed.

The operating environment in which the present invention is used encompasses a standalone computing system as well as a general distributed computing system. In the distributed computing system, general purpose computers, workstations, or personal computers are connected via communication links of various types in a client-server arrangement. Programs and data, many in the form of objects, are made available by various members of the system. Some of the elements of a standalone computer or a general purpose workstation are shown in FIG. 3, wherein a processor 21 is shown, having an input/output (I/O) section 22, a central processing unit (CPU) 23 and a memory section 24. The I/O section 22 is connected to a keyboard 25, a display unit 26, a disk storage unit 29, 30 and 31, a CD-ROM drive unit 27, and a network 32. The CD-ROM unit 27 can read a CD-ROM medium 28 which typically contains programs 45 and data. The computer program products containing mechanisms to effectuate the apparatus and methods of the present invention may reside in memory section 24, on the disk storage unit 29 or 31, or on the CD-ROM 28 of such a system. Examples of such systems include SPARC Systems offered by Sun Microsystems, Inc., personal computers offered by IBM Corporation and by other manufacturers of IBM compatible personal computers, and systems running UNIX operation systems such as SOLARIS and LINUX operating systems.

Remote computing stations 33 are interconnected over network 32 for sharing data and network resources. Each of the remote computing stations 33 could include similar elements as shown in FIG. 2 and described above. It is understood that the present invention could be operated on any of the computing stations 33. Generally, it is understood that the present invention could be run on any system on a network and displayed on a remote system. While the display machine may have an 8-bit display, the software of the present invention can operate on the server which may not have any form of a display.

Preferably the invention can be embodied in a computer program product. It will be understood that the computer program product of the present invention preferably is created in a computer usable medium, having computer readable code embodied therein. The computer usable medium preferably contains a number of computer readable program code devices configured to cause a computer to affect the various functions required to carry out the invention, as herein described.

The embodiments of the invention described herein are implemented as logical operations in a computing system. The logical operations of the present invention are implemented (1) as a sequence of computing implemented steps running on the computing system and (2) as interconnected machine modules within the computing system. The implementation is a matter of choice dependent on the performance requirements of the computing system implementing the invention. Accordingly, the logical operations making up the embodiments of the invention described herein are referred to variously as operations, steps, or modules.

As shown in FIG. 3, the present invention could be embodied within in application program 45 operating within the computing system. The application program 45 could be accessed over network 32 by remote stations 33, or accessed locally by the CPU 23. The software interface 10 of the present invention (shown in FIG. 2) could be stored within disc storage unit 29, the floppy disc 31, or the CD-ROM medium 28. Alternatively, the software interface 10 could be stored remotely within the storage devices associated with remote computers 33. The location of the software interface and related files is a matter of choice dependent upon the particular implementation chosen, and does not limit the scope of the present invention.

Figure 4A:
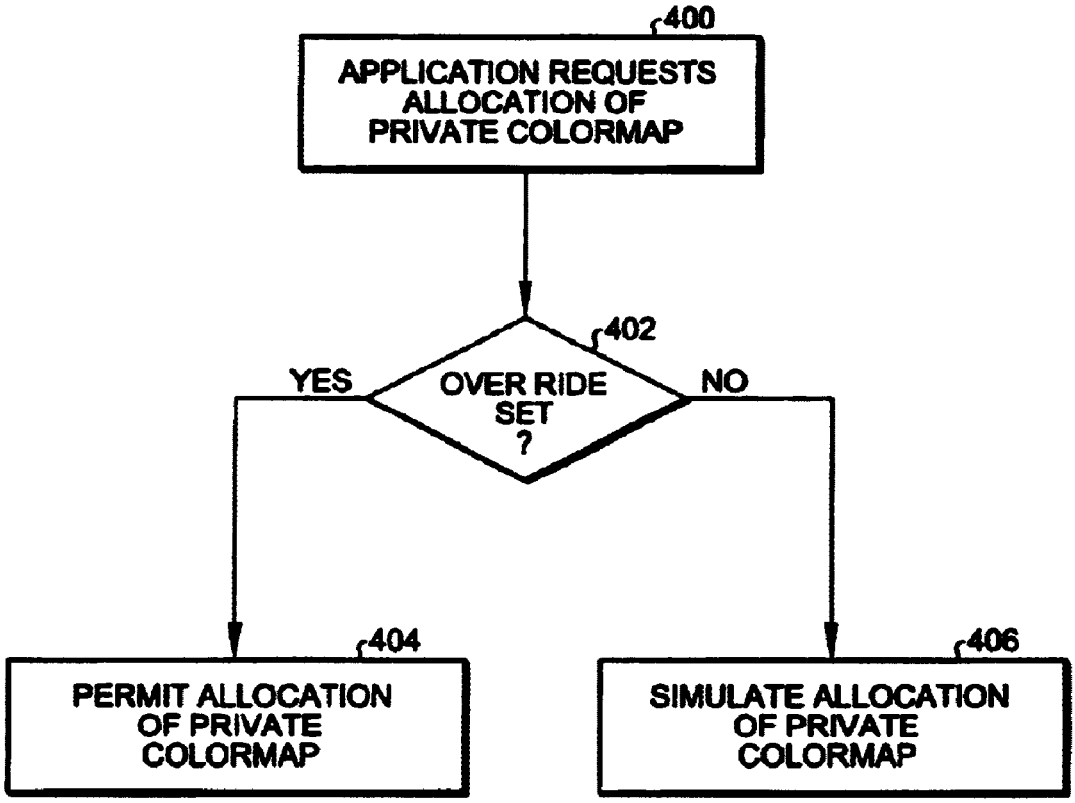
FIGS. 4A–B illustrates an embodiment of the logical operations of the present invention.

FIG. 4A illustrates a general flow diagram in accordance with one embodiment of the present invention. As seen in FIG. 4A, the process begins with operation 400 where the application (i.e., the X-client) requests an allocation of a private colormap. In response to this request, the present invention intercepts the request and processes the request as shown in FIGS. 4 and 5. Referring to FIG. 4A, decision operation 402 determines whether the user controlled override in the software configuration module of the present invention has been enabled. In particular, the configuration module contains user selectable options which can be configured before the program code of the present invention is compiled or during run time of the software. The override options would permit the X-client application to utilize the X library functions as is conventionally done without interference by the software. In this manner, the override control would permit the user to select a mode where the user would understand that colormap flashing would be present. This may be desirable for certain viewing applications, for example. If the user controlled override is disabled, then the software would simulate allocation of a private colormap in accordance with the present invention.

In particular, if decision operation 402 determines that the user controlled override is enabled, then control is passed to operation 404, where allocation of the private colormap by the X-client is permitted. However, if decision operation 402 determines that the user controlled override is disabled, then control is passed to operation 406 which performs one or more steps to simulate allocation of a private colormap in accordance with the present invention. In this sense, "simulating allocation" of the private colormap involves transparently using a secondary lookup table, which can be stored in conventional memory, having entries which are mapped to the entries of the default colormap. This secondary lookup table is used so that the application program (X-client) "believes" that it is still properly obtaining an allocated private colormap for its use, however in actuality, the default colormap is utilized. In this general manner, colormap flashing is prevented since the default colormap is retained in the frame buffer, rather than being swapped out. Instead of returning a "private" colormap, the software returns a reference to the default colormap and then provides functionality so that the default colormap behaves like a private colormap.

Figure 4B:
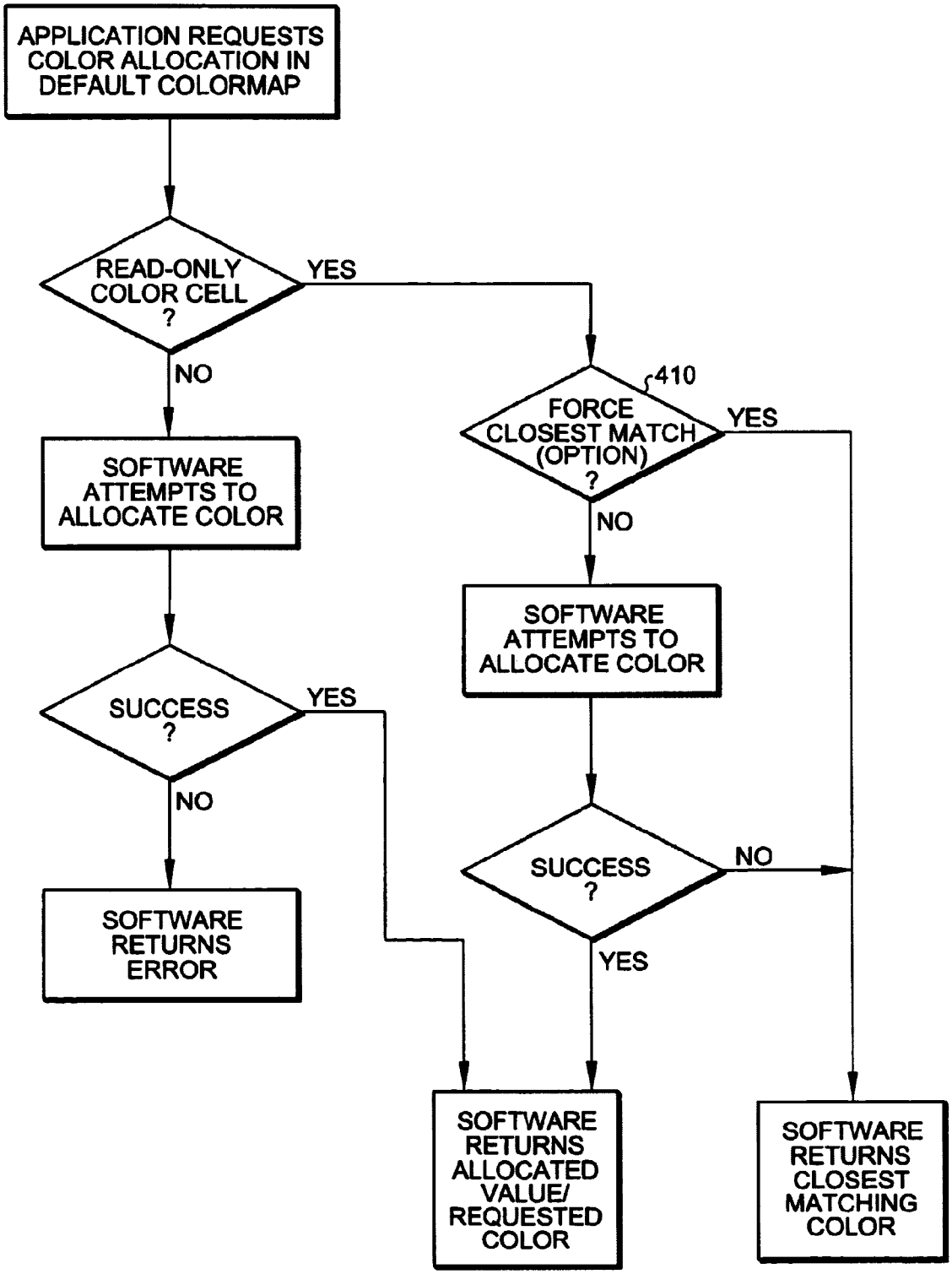
Figure 5:
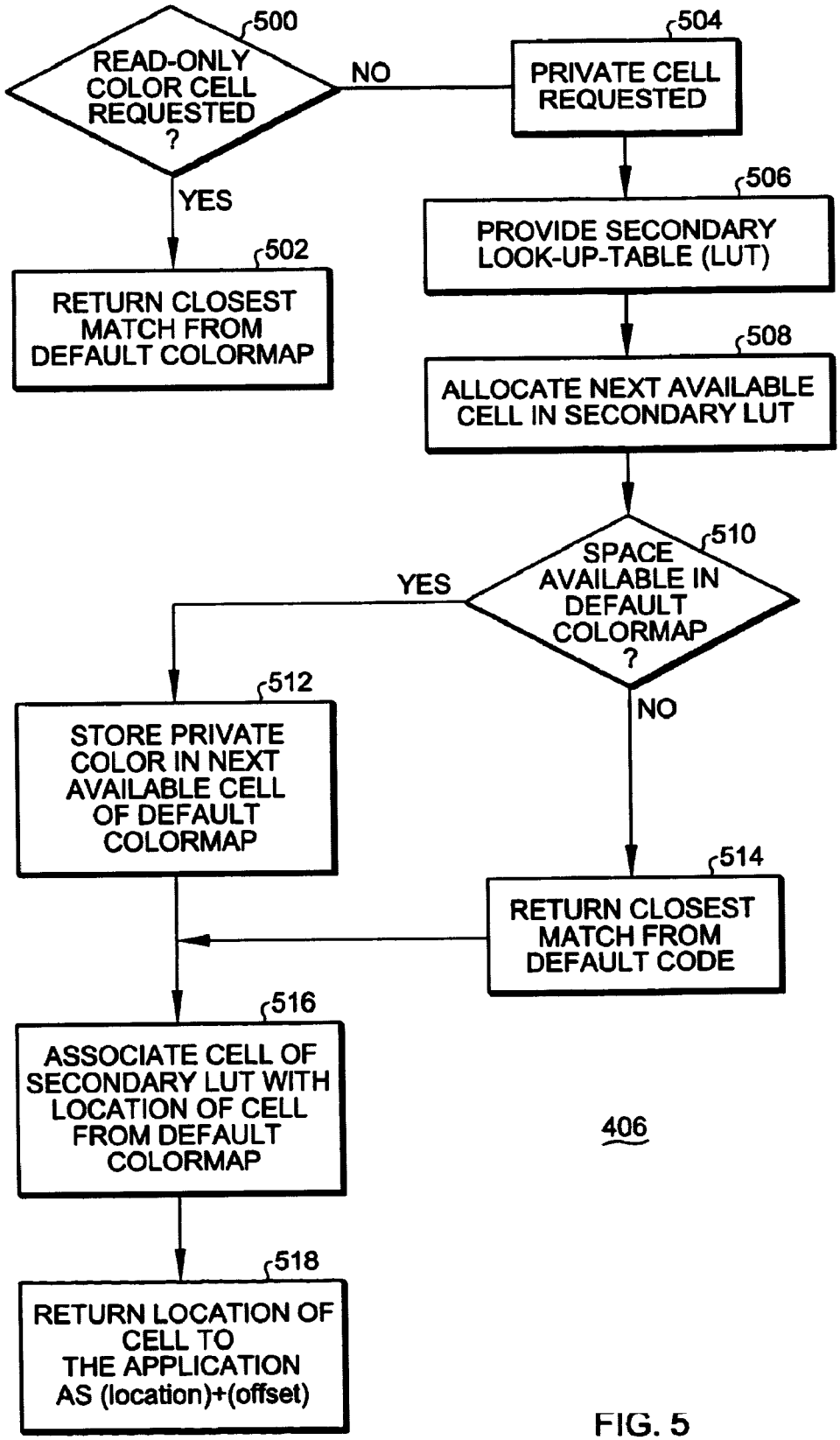
FIG. 5 illustrates an embodiment of the logical operations of the present invention to simulate allocation of a private colormap.

FIG. 4B illustrates how the software behaves when the application attempts to allocate a color in the default colormap. If the application attempts to allocate a read-only color, the cell can be shared with other applications. The user can elect to force the application to always use the closest matching color, as shown by decision operation 410, or the system can be configured to attempt to satisfy the request. If the colormap is full and the request cannot be satisfied fully, the system will return the nearest matching color. This method cannot be used for read-write colors, so the default allocation method is used. If the allocation fails, the error is returned as normal.

Referring to FIG. 5, the operations for simulating allocation of a cell in a simulated private colormap, in accordance with a preferred embodiment of the present invention, are illustrated. Decision operation 500 determines if the client application has requested a read only color cell. If decision operation 500 determines that a read only cell has been requested, then control is passed to operation 502 (which is also operation 410 in FIG. 4B).

If decision operation 500 determines that a read only color cell has not been requested, then control is passed to operation 504. Operation 504 determines that a private color cell has been requested. A private or "writeable" color cell is a color cell in which the value in the cell can change. Due to the changeable nature of these cells, these private cells should not be shared generally amongst applications since the applications using the cell cannot guarantee that the value will remain constant, however, a private cell can be written into an empty cell of the default colormap, provided that there is sufficient unallocated space remaining in the colormap.

In accordance with the present invention, operation 506 provides a secondary lookup table in conventional memory. As discussed above, this lookup table may be of arbitrary size but should have at least 256 cells, each non-empty cell corresponding to and mapping to a cell of the default colormap. Several cells in the simulated private colormap may in fact map to the same entry in the default colormap. The effect of this would be that the application might "believe" that the cells contain different, but possibly very similar, colors. Similarly, the image displayed may use several different colors, but in fact they may map to the same viewable color. The manner in which each non-empty entry of the secondary lookup table is mapped to an entry of the default colormap depends upon the request made by the X-client's application, as will be discussed below.

Operation 508 allocates the next available cell in the secondary lookup table to satisfy the X-client's requests for an allocation of a private cell.

Decision operation 510 determines if there is space available in the default colormap to support the private cell requested by the X-client application. In other words, if the default colormap has empty cells, then the private color can be stored within the empty cell of the default colormap. If so, operation 512 stores the private color in the next available cell of the default colormap. This cell will be allocated as a shared (read-only) cell. If decision operation 510 determines that there is no space available in the default colormap, then operation 514 performs a closest match to match the private color to a closest match of a read-only color in order to satisfy the X-client's private cell request. Control is then passed to operation 516.

Operation 516 associates a cell of the secondary lookup table with the location of the cell from the default colormap. The location of the cell from the default colormap will either be the location of the cell which was written to by operation 512 with the new color data, or the closest matching cell of the default colormap determined by operation 514.

Operation 518 then returns the location of the color cell with reference to the secondary lookup table. In this manner, all private cells are referenced with respect to the secondary lookup table. References to the secondary lookup table can easily be marked merely by setting bits outside the range of valid 8-bit pixel values, for example, (100) hex added to the location of the cell within the secondary lookup table. In this manner, the offset of (100) hex makes it possible to detect references into the secondary lookup table.

Accordingly, it can be seen through FIGS. 4–5 that the request from the X-client application program for an allocation of a private colormap has been satisfied without having to overwrite or "switch out" the default colormap from the frame buffer. In this manner, colormap flashing is eliminated. It should be noted that the returned value will be more than 8 bits in size. This is acceptable since the X Windows protocol specifies that pixel values are long (32 bit) integers. The application cannot know in advance whether the display is 8 bit or 24 bit so it must allocate enough space for the worst case. It is believed that this holds true in non-X Windows environments.

Figure 6A:
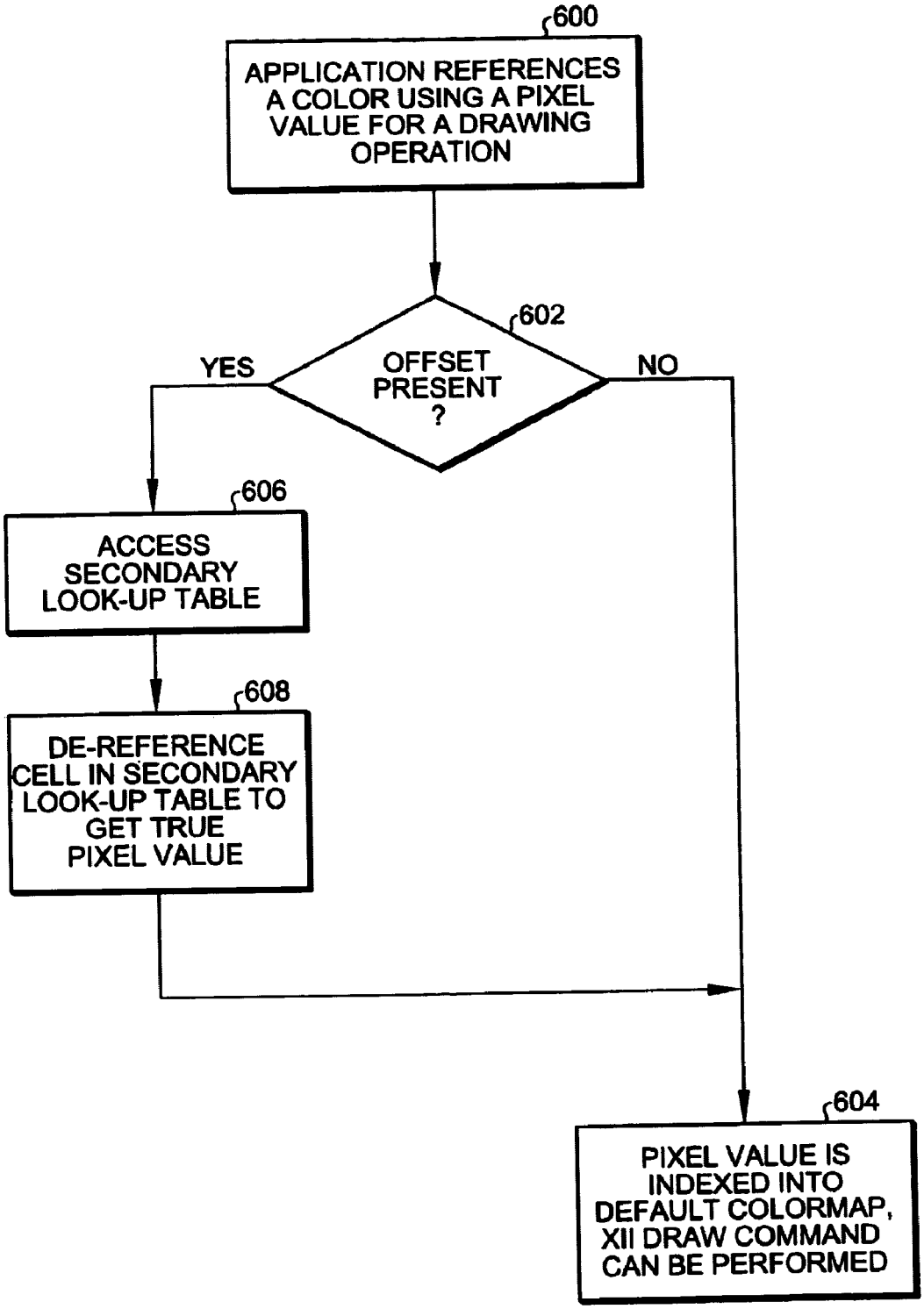
FIGS. 6A–B illustrate an embodiment of the logical operations of the present invention to satisfy an application's reference to a color with a reference value (read/write).

FIG. 6A illustrates the logical operations for handling a reference by a X-client application program to write or draw using a particular color. Beginning with operation 600, an application program references a particular color cell using a pixel value for a drawing operation. Decision operation 602 determines whether the "offset" flag is set. If the flag is not set, this indicates that the value is a normal pixel reference into the default colormap and should be treated as such, and control is passed to operation 604 where the X routine draw command can be performed. If the flag is set as determined by operation 602, this indicates that the value is an index into the secondary lookup table. At operation 606 the secondary lookup table is accessed, and at operation 608, the software de-references the index to obtain an index into the default colormap (to get the true pixel value). This index is then passed to the X routine responsible for processing the draw request at operation 604. From this it can be seen that the software must override all X routines that handle draw requests if it is to operate as requested.

Figure 6B:
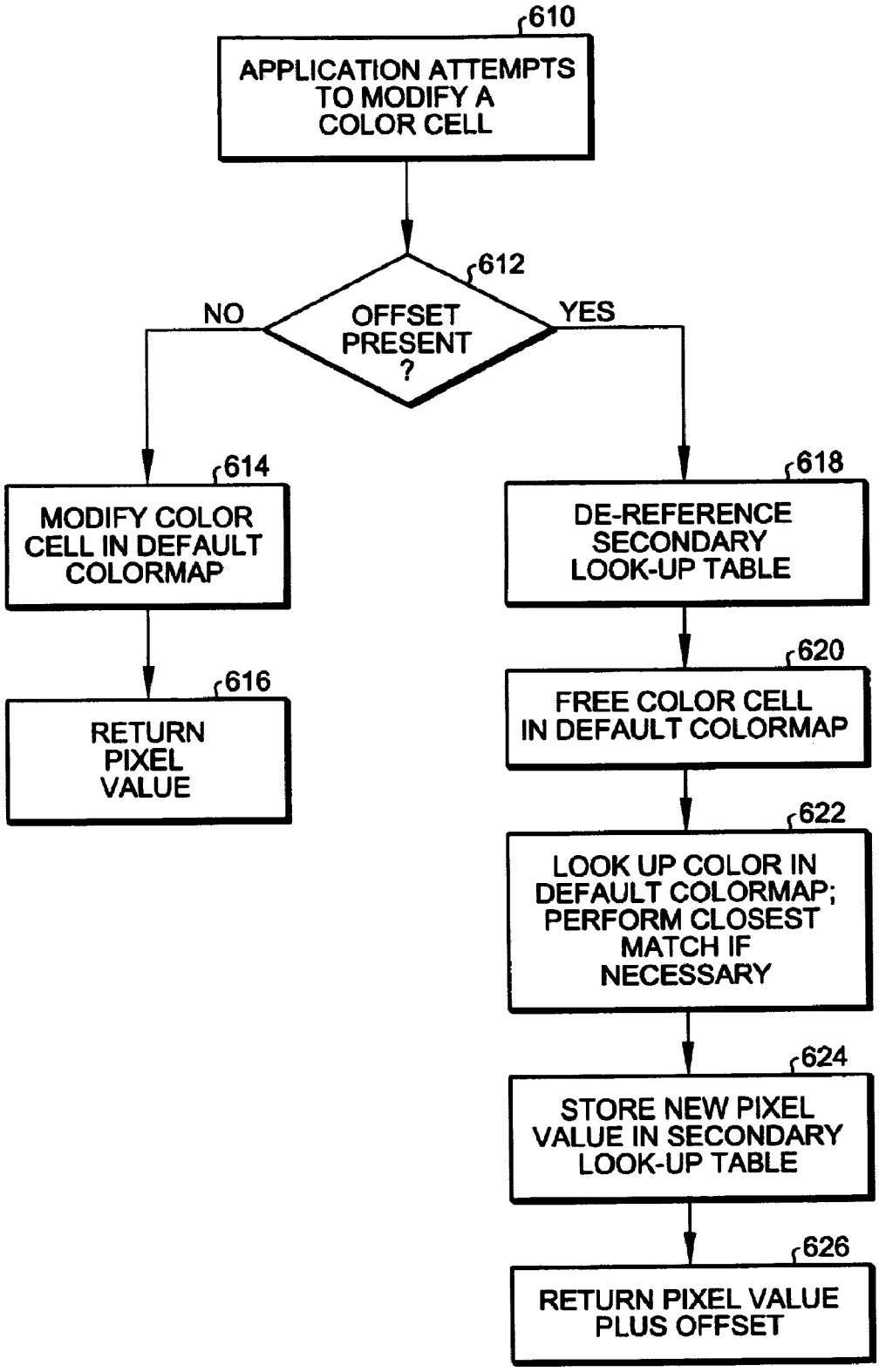

FIG. 6B illustrates the actions taken when an application attempts to modify the value of a private color cell. Beginning at operation 610, decision operation 612 determines whether the offset is present. If not, the system updates (modifies) the color values in the default colormap at operation 614 and returns the updated pixel value at operation 616. If the offset is present as determined by operation 612, at operation 618, the system de-references the value in the secondary lookup table. At operation 620, the allocated color cell is then freed in the default colormap. At operation 622, the new color is attempted to be allocated in the default colormap, as described earlier with reference to operations 510–518, and at operation 624, the new pixel value is stored in the secondary lookup table. At operation 626, the pixel value plus the offset is returned.

Some graphical software applications assume that, having allocated a private colormap, they are free to use it in its entirety without regard to the normal X protocol requests. In order to handle this situation, in an alternative embodiment, a private colormap can be allocated, but this can then can be divided by the interface software of the present invention into a reserved portion and a private portion.

The software would then copy a number of colors from the default colormap into the reserved portion of the private colormap. These colormap entries would be preserved by the invention and any attempt to modify these colors would be silently denied, meaning that no error would be generated. The system would be told that the "write" had taken place but no colors would have changed. Only the private portion of the table would be allowed to be modified (depending on the application, this section of the colormap could be protected simply by using the standard X allocation routines to mark the cells as "used"). The advantage of this method is that it is less invasive and allows the application much greater control over the private colormap. The disadvantage is that it does not entirely resolve the colormap flashing issue but may be necessary for certain legacy applications.

The software of the present invention could be configurable so that the user could select which embodiment of the invention would be operable in a particular instance either at run time or during compilation. A configuration table could be provided which would permit the user to selectably define which invention interface is used depending upon the graphical applications which will be run on the computing system.

In accordance with the present invention, the software program code for the masked interface of the present invention must be inserted into existing software systems before the real libraries are accessed. This can be done in a variety of ways depending on the operating system. For example, if the source to the X libraries is available, a new version of the library can be created replacing the existing version. Some operating systems support the concept of a "pre-loadable" library. For example, in SOLARIS (™), the UNIX implementation from Sun Microsystems, the library can be invoked by setting the LD_PRELOAD environmental variable. Thus:

% LD_PRELOAD "/my_dir/library.so"

In this way the masked interface call of the present invention receives the call and processes the call as described above. In this manner, the present invention provides a legacy solution without the need to be integrated with a new release of the existing software.

One form of the invention is described in the below pseudo-code. It is understood that there are many other possible implementations of the same basic functionality embodied in the pseudo-code which a person of ordinary skill in the art could implement without departing from the scope of the invention. For simplicity, the code describes an implementation based around the X API, but could be used with an alternate API. In the pseudo-code, the terms "colour" and "color" are used interchangeably.

```
ALREADY INITIALIZED = FALSE
Define variables
Integer   PROTECT    Number of colormap entries to protect
Flag      NOALLOC    If true, don't pre-allocate protected colours
Flag      FORCE      If true, force closest match in all cases.
                     This presumes that another process has already
                     loaded the colormap with values.
Flag      LOOKUP     If true, create a lookup table for private colormap.
Declare a PRIVATE COLORMAP. This will initially be null
until allocated.
Declare a LOOKUP TABLE. This should be at least as large
as the default colormap (256 entries). Each table entry
needs to have a lookup value.
There needs to be a way to indicate whether a table entry
is being used.
A PIXEL VALUE is a 32 bit value (depending on implementation)
indicating a real entry into the colormap. Under the normal circumstances
of this program it will be a value in the range 0 to 255. (this assumes an
8 bit frame buffer).
An INDIRECT PIXEL VALUE is a 32 bit value indicating an entry
into the Lookup Table.
Given any 32 bit value there must be a way of distinguishing
whether it indicates a PIXEL VALUE or an INDIRECT PIXEL VALUE.
This can be done by setting one or more bits within the value.
Now we redefine each of the X library calls that we need to over-ride -
ie any that use color cells. Our function will be called instead of
the real library function, but we have a way to call the real one.
Status XAllocColorCells(Display *dpy, Colormap map, Bool contig,
  long *plane_masks, int nplanes,
  long *pixels, int npixels)
{
  IF NOT ALREADY INITIALIZED
    INITIALIZE
  [This applies to all the X library calls that are over-ridden.]
  [For clarity it will be omitted in future cases]
  Ensure that the colormap supplied is our "private" colormap,
  that the number of pixels to allocate is > 0
  and that the table has been initialized.
  If not, call the real XAllocColorCells.
  We have a private colormap, a lookup table, and a request for pixels.
  Look through the lookup table and see if we have space to allocate
  the new entries. If so, we do this by setting the flags in the table.
  The pixel values we return are the array indices plus the table size.
  This is fine, because a pixel is a long; we are unlikely to exceed a short.
  First check to see if there is room in our table to allocate
  the number of pixels. If not, return an error, or grow the table.
  For each pixel requested return an INDIRECT PIXEL VALUE
  indicating an entry into the lookup table. Mark the entry
  as allocated.
}
int XFreeColors(Display *dpy, Colormap map, long* pixels, int count,
  long planes)
{
  For every supplied INDIRECT PIXEL VALUE
  mark it as no longer used and free the associated pixel value (if any)
  For every supplied PIXEL VALUE call the real XFreeColors
}
XQueryColor(Display *dpy, Colormap map, XColor* colour)
{
  If the pixel value supplied is an INDIRECT PIXEL VALUE
  dereference it, then call the real XQueryColor
  Otherwise just call the real XQueryColor
}
XQueryColors(Display *dpy, Colormap map, XColor *colours, int count)
{
  For each pixel {
    If the pixel value supplied is an INDIRECT PIXEL VALUE
```

-continued

```
    dereference it, then call the real XQueryColor
    Otherwise just call the real XQueryColor
  }
  Note that this loop should be optimized for speed.
}
XStoreColor(Display *dpy, Colormap map, XColor* colour)
{
  If the supplied value is an INDIRECT PIXEL VALUE
  find the closest match in the colormap and update
  the lookup table.
  If the supplied value is a PIXEL VALUE
  and it is one that we are protecting,
  ignore the request and return success
  Otherwise call the real XStoreColor
}
XStoreColors(Display *dpy, Colormap map, XColor *colours, int count)
{
  For each pixel {
    If the supplied value is an INDIRECT PIXEL VALUE
    find the closest match in the colormap and update
    the lookup table.
    If the supplied value is a PIXEL VALUE
    and it is one that we are protecting,
    ignore the request and return success
    Otherwise call the real XStoreColor
  }
  Note that this loop should be optimized for speed.
}
XStoreNamedColor(Display *dpy, Colormap map, char *name, long pixel,
int flag)
{
  As for XStoreColor.
}
Colormap XCreateColormap(register Display *dpy, Window w,
Visual *visual, int alloc)
{
  The application requests a private colormap.
  This is the root cause of colormap flashing.
  The intention is to fool the application into believing that this
  action has succeeded, when in fact it is using the default colormap.
  Determine the type and depth of the selected visual.
  It may not be necessary to do this for all visuals.
  If a lookup table is to be used, allocate and initialize it.
  return the default colormap.
  If not, colormap flashing will occur but can be reduced.
  First, allocate the private colormap.
  Next, copy across the current values from the default colormap.
  Finally, in most cases it is wise to pre-allocate the first N cells
  to prevent them from being used by the application since we won't
  allow it to use them anyway. Some applications expect to get the full
  256 cells and give an error if this is not the case (example: xcolor)
  Return the private colormap.
}
Status XAllocNamedColor(Display* dpy, Colormap map, char *c,
XColor*x1, XColor*x2)
{
  As for XAllocColor, except that it is first necessary to parse the
  supplied colour to obtain its RGB values.
}
Status XAllocColor(register Display *dpy, Colormap cmap,
XColor *xcolor)
{
  Unless it is decided to force closest-matching on all allocation calls,
  begin by calling the real XAllocColor.
  If XAllocColor returns an error - ie it is unable to allocate the colour
  in the default [or supplied] colormap, find the closest match.
  This algorithm may vary depending on the local display, gamma
correction etc.
  Be sure not to match against a read-write colour.
  When the match has been determined, call the real XAllocColor again.
  This allows the server to keep track of how many references there are to
a cell.
}
The following X calls all use colour in some way. In each case it is
necessary to determine whether the value passed is an entry in the
secondary lookup table, in which case we dereference the value to give
the
real pixel value. Note that this does give a window for error. If the
application attempts to modify the colours, the modifications will not be
```

-continued

```
reflected on the screen. In order to do this it would be necessary to keep a
record of what each colour is used for, then to update the screen
accordingly.
While this would be possible my current view is that this would cause an
unacceptable performance hit for very little gain.
XSetForeground(Display *dpy, GC gc, long pixel)
XSetBackground(Display *dpy, GC gc, long pixel)
XSetWindowForeground(Display *dpy, Window w, long pixel)
XSetWindowBackground(Display *dpy, Window w, long pixel)
Similarly, calls that involve creating or modifying the GC (Graphics
Context) may pass pixel values, for example in the Foreground or
Background values.
It is therefore necessary to determine which values are being set by
analyzing the mask. If the values are colours, then it may be necessary to
dereference.
GC XCreateGC(Display *dpy, Drawable d, long mask,
XGCValues *values)
XChangeGC(Display *dpy, GC gc, long mask, XGCValues *values)
Here is the initialization code.
void init(Display *dpy)
{
  First off, determine the name of the executable and set defaults
  accordingly. This enables the application to tailor its default behavior to
  fulfil the requirements of known "problem" (non-standard) applications.
  A good example is xcolor.
  In Solaris this is done by querying the proc table.
  Next, get handles to the *real* library routines.
  Check if the user has set environmental variables which may override
  the application defaults.
  If required, pre-allocate certain colours. This may be necessary if it is
  considered optimal to always run with closest-matching turned on;
  the application needs a defined set of colours to match against.
}
```

Accordingly, the present invention reduces colormap flashing by transparently preventing the default colormap from being switched out of the frame buffer, while satisfying the needs of the graphical application program.

While the method disclosed herein has been described and shown with reference to particular steps performed in a particular order, it will be understood that these steps may be combined, sub-divided, or re-ordered to form an equivalent method without departing from the teachings of the present invention. Accordingly, unless specifically indicated herein, the order and grouping of the steps is not a limitation of the present invention.

While the invention has been particularly shown and described with reference to a preferred embodiment thereof, it will be understood by those skilled in the art that various other changes in the form and details may be made without departing from the spirit and scope of the invention.

What is claimed is:

1. A method of reducing colormap flashing on a display system, the display system having a frame buffer which provides a single hardware colormap, the method comprising the steps of:

intercepting a request from an application program for an allocation of a private colormap; and transparently simulating the allocation of the private colormap using a default colormap, wherein the default colormap is retained in the frame buffer during the simulating and the simulating includes allocating a secondary lookup table for storing information received from the application program relating to the intercepted request and wherein said step of transparently simulating the allocation of a private colormap further comprises:

storing in the secondary lookup table information received from said application program relating to one or more requested colors privately allocated by said application program;

performing a closest match of said requested color to a color stored in said default colormap; and returning said closest match to said application program.

2. A computer program product, comprising:

a computer usable code storage medium;

computer readable code embodied in said storage medium for reducing colormap flashing on a display system, the display system having a single hardware colormap, the computer readable code comprising:

computer readable code devices to cause a computer to effect intercepting a request from an application program for an allocation of a private colormap; and computer readable code devices to cause a computer to effect transparently simulating the allocation of the requested private colormap by providing a reference to a cell in a default colormap and retaining the default colormap in a buffer, whereby creation of and swapping to the requested private colormap are not performed by the computer program product.

3. The computer program product of claim 2, wherein said computer readable program code devices configured to cause a computer to effect transparently simulating the allocation of a private colormap further comprises:

computer readable code devices to cause a computer to effect allocating a secondary lookup table for storing information received from said application program relating to one or more requested colors privately allocated by said application program;

computer readable code devices to cause a computer to effect performing a closest match of said requested color to a color stored in said default colormap; and computer readable code devices to cause a computer to effect returning said closest match to said application program.

4. The method of claim 1, comprising the step of determining whether a private color cell has been requested by the application program and writing said private color cell to the default colormap.

5. A method for reducing colormap flashing on a display system, the display system having a frame buffer which provides a single hardware colormap, the method comprising the steps of:

intercepting a request from an application program for an allocation of a private colormap;

transparently simulating the allocation of the private colormap using a default colormap, wherein the simulating includes allocating a secondary lookup table comprising entries mapped to entries in the default colormap; and determining whether a private color cell has been requested by the application program and writing said private color cell to the default colormap.

6. The method of claim 1, further including prior to performing the storing, determining whether the requested color was for a read-only color cell, when determined not a read-only request, performing the storing and only performing the performing the closest match and the returning when a space is not available in the default colormap, and when determined a read-only request skipping the storing and performing the performing the closest match and the returning the closest match.

7. A method of reducing colormap flashing on a display system, the display system having a frame buffer which provides a single hardware colormap, the method comprising the steps of:

intercepting a request from an application program for an allocation of a private colormap; and transparently simulating the allocation of the private colormap using a default colormap, wherein the default colormap is retained in the frame buffer during the simulating and the simulating includes allocating a secondary lookup table for storing information received from the application program relating to the intercepted request;

wherein the simulating includes associating a cell in the secondary lookup table with a location of a cell in the default colormap and returning the location of the cell in the default colormap to the application program as a response to the intercepted request.

* * * * *